US005709174A

United States Patent [19]

Ledjeff et al.

[11] Patent Number: 5,709,174

[45] Date of Patent: Jan. 20, 1998

[54] HOT WATER HEATER

[75] Inventors: Konstantin Ledjeff, Muehlheim; Juergen Gieshoff, Reute; Alexander Schuler, Freiburg, all of Germany

[73] Assignee: Fraunhofer-Gesellschaft zur Foerderung der angewandten Forschung e.V., Munich, Germany

[21] Appl. No.: 553,371

[22] PCT Filed: May 24, 1994

[86] PCT No.: PCT/EP94/01667

§ 371 Date: Nov. 27, 1995

§ 102(e) Date: Nov. 27, 1995

[87] PCT Pub. No.: WO94/28359

PCT Pub. Date: Dec. 8, 1994

[30] Foreign Application Priority Data

May 26, 1993 [DE] Germany ..... 43 17 554.6

[51] Int. Cl.[6] ..... F22B 5/00

[52] U.S. Cl. ..... 122/17; 431/328; 122/367.1

[58] Field of Search ..... 431/328; 126/361, 126/92 A, 92 C; 122/367.1, 367.3, 17

[56] References Cited

FOREIGN PATENT DOCUMENTS

| | | |
|---|---|---|
| 33 32 572 | 3/1985 | Germany . |
| 34 25 259 | 1/1986 | Germany . |
| 42 04 320 | 8/1993 | Germany . |

*Primary Examiner*—Henry A. Bennett
*Assistant Examiner*—Gregory A. Wilson
*Attorney, Agent, or Firm*—Evenson, McKeown, Edwards & Lenahan, P.L.L.C.

[57] ABSTRACT

A hot water heater has an inlet for liquid fuels, a plurality of inlets for fresh air, an inlet for a fluid to be heated, at least two combustion stages traversed by the fuel-air mixture with catalytic combustion chambers surrounded at least partially by at least one fluid chamber filled with fluid and with an offgas heat exchanger for fluid to be heated. The heat exchanger is traversed by the offgas escaping from the combustion chambers. The first combustion stage has an evaporation chamber that has on its outside surface, at least a partial catalyst layer.

12 Claims, 3 Drawing Sheets

HOT WATER HEATER

BACKGROUND AND SUMMARY OF THE INVENTION

The invention relates to a hot water heater with an inlet for liquid fuels, a plurality of inlets for fresh air, an inlet for a fluid to be heated, at least two combustion stages which are traversed by the fuel-air mixture and have catalytic combustion chambers surrounded at least partially by at least one fluid chamber filled with fluid, and with an offgas heat exchanger for the fluid to be heated, which is traversed by the offgas escaping from the combustion chambers.

A hot water heater as generally described above is known for example from German Patent document DE-OS 33 32 572. In addition, a hot water heater is likewise described in German Patent document 42 04 320.4 wherein the heater, in particular has a first advantageous combustion stage. This reference provides background information on the first and second combustion stages. For improved clarity, the reference numerals in this application partially correspond to those in German Patent document 42 04 3204.

When fossil fuels are burned, in addition to the greenhouse gas carbon dioxide, additional pollutants such as sulfur dioxide and oxides of nitrogen are produced. In conventional flame burners, the reduction possibilities, primarily for the oxides of nitrogen, are limited by flame stability and the formation of carbon monoxide. A definite reduction in the emission of oxides of nitrogen can be achieved in flameless combustion on oxidation catalysts (platinum for example) as a result of the low reaction temperature. Catalytic burners also offer the advantage that mixtures of fuels with different energy densities can be reacted stably over a wide range of mixing ratios.

Burners for gasoline, diesel fuel, or methanol for example, are available today only as conventional flame burners. Because of the high reaction temperature (flame temperature) such burners have high nitrogen oxide emissions. There are ways in which emissions can be reduced even in such burners, for example by flame cooling or changing the percentage of air, but this causes the flame stability to decrease and the carbon monoxide emissions to increase.

This prior art has the disadvantage that it is not especially suitable for liquid fuels. Hence, there is therefore needed an improved hot water heater such that liquid fuels can be used without significant cracking.

The present invention meets this need by providing a hot water heater with an inlet for liquid fuels, a plurality of inlets for fresh air, an inlet for a fluid to be heated, at least two combustion stages which are traversed by the fuel-air mixture and have catalytic combustion chambers surrounded at least partially by at least one fluid chamber filled with fluid, and with an offgas heat exchanger for the fluid to be heated, which is traversed by the offgas escaping from the combustion chambers. The first combustion stage has an evaporation chamber which has at least partially on its outer surface, a catalyst layer of a catalytic combustion chamber of the first combustion stage. The invention makes it possible to thermally couple the first stage of the two-stage catalytic burner to the evaporation chamber.

One advantageous improvement on the catalytic cracking burner is that the first catalytic combustion chamber of the first combustion stage is designed as a catalytic cracking burner.

It is also advantageous for the evaporation chamber to be designed as a combustion chamber, for which purpose it has an ignition device. A bypass for the feed for the liquid fuel can serve as the igniting flame for example. In addition, the hot water heater has a supply of primary air for the combustion chamber for this purpose.

It is further advantageous if the fuel is supplied in isolation so that the fuel enters the combustion chamber without cracking.

It is also advantageous to provide a nozzle or other devices for atomizing the fuel.

It can also be advantageous to recycle a portion of the offgas from the first stage into the evaporation chamber, since the liquid fuel is then evaporated more easily and the water or steam that is created during the combustion process likewise minimizes any possible cracking reactions.

It is further advantageous to provide devices for directing the gas stream inside the combustion chamber; in particular these devices can be thermally insulated if they are not heated by the first combustion stage.

It is also advantageous to make the evaporation chamber rotationally symmetrical and to cause it to rotate, since the fuel is then pressed against the wall and comes into better contact there with the wall that is heated on the back by the first combustion stage because of the conversion reaction of the combustion gas-air mixture on the catalyst layer.

DETAILED DESCRIPTION OF THE DRAWINGS

The subject of the application is a two-stage catalytic burner for liquid fuels and their mixtures with internal evaporation or gasification. The fuel, possibly with the addition of air (primary air) is evaporated or gasified inside the burner. The energy required for this purpose is provided by the heat of combustion. The mixture of combustion gas and air (with secondary air added, which can be the sole supply of air after the starting phase) flows over a catalytic surface and is converted up to approximately 80 to 85%. The reaction temperatures are approximately 800° to 900°C. Heat is drawn off into the cooling medium and the evaporation zone by radiation, heat conduction, and convection. In the second stage the remaining fuel is reacted in a monolithic catalyst. The narrow channels ensure good material transport and hence high power density. Temperatures of approximately 1,000° C. are reached and permit a complete reaction. A portion of the heat can be drawn off from the monolith for preheating the primary air, which is advantageous, for example, with intermittent operation.

Figure 1:
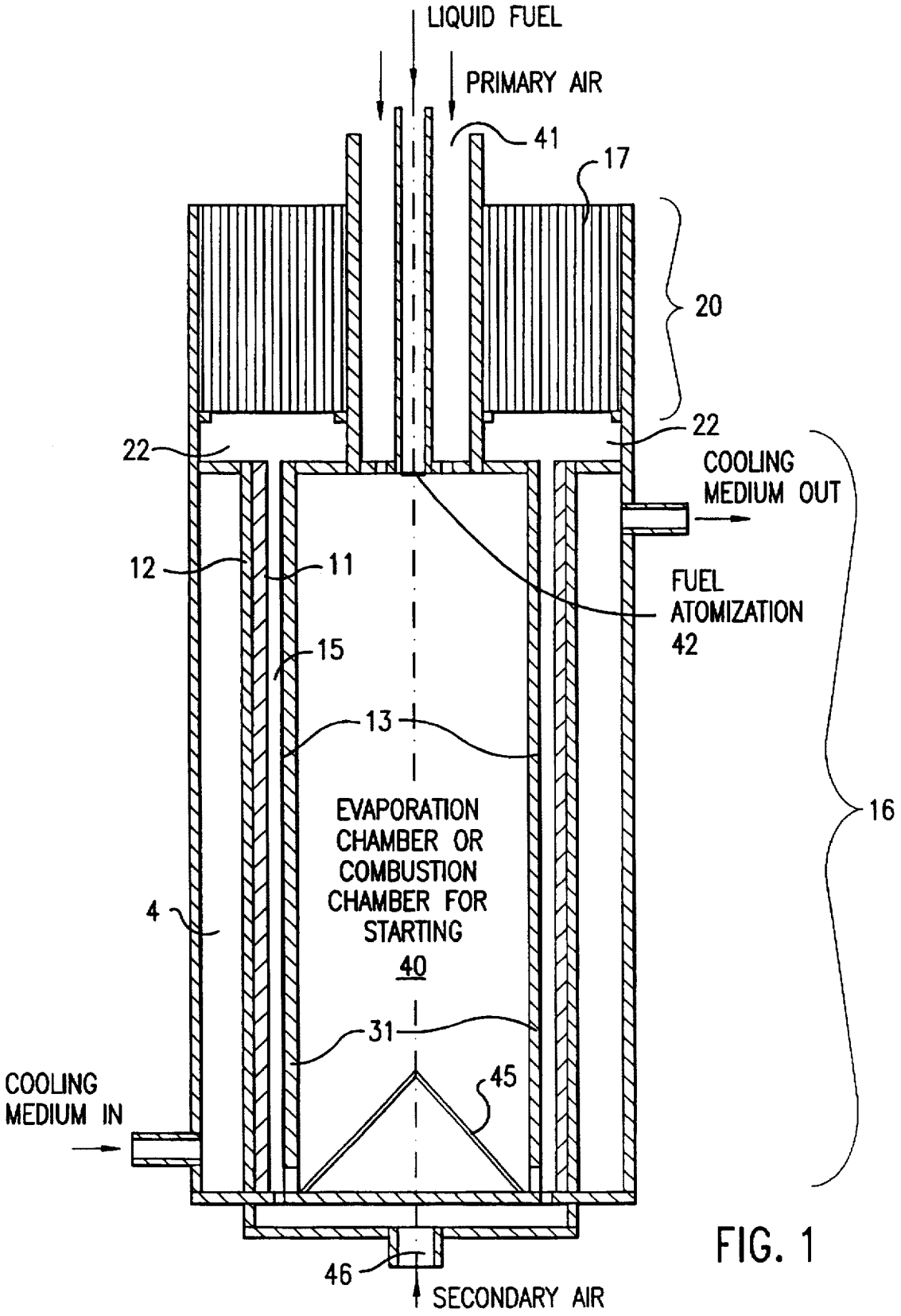
FIG. 1 is a cross-sectional representation of a catalytic burner according to the present invention.

Referring to FIG. 1, the catalytic burner consists of two stages 16, 20. The first stage 16 consists of a metal tube 31 coated on the outside with the catalyst 13, such as a ceramic tube. This catalyst tube 13 is surrounded by a ceramic or metal tube 11 which functions as an exhaust gas heat exchanger, and a cooling jacket 12 having a fluid chamber 4 for a cooling medium 2, so that a gas gap 15 results between the catalyst tube 13 and the ceramic tube 11. The mixture of evaporated gaseous fuel and air flows in this gas gap 15 and reacts at the catalytic surface of tube 31. The second stage 20, located above the first stage 16, consists of a ceramic honeycomb structure 17 (monolith) coated with catalyst. The offgas (exhaust gas) from the first stage 16 together with the remaining fuel flows through this monolith 17 where it reacts completely. The source of the primary air and liquid fuel mixture is located centrally in the monolith.

Two tubes 8 and 41 arranged concentrically and passing through the monolith 17 from above serve to introduce the liquid fuel and primary air. The primary air flows in outer tube 41 and is preheated by the adjoining monolith 17. The liquid fuel flows in the inner tube 8. The inner tube 8 is only slightly preheated since the gas gap between this tube and the monolith has an insulating effect so that no evaporation or cracking can occur in the inner or "feed" tube 8. These concentric tubes 8, 41 terminate at the level of the upper edge of the first burner stage 16. The liquid fuel is added, finally atomized by means of a nozzle 42, to the interior of the catalyst tube 13 of the first burner stage 16 which thus forms evaporation chamber 40 or the burner or combustion chamber. The concentrically supplied primary air, preheated by the monolith, likewise flows through holes provided in an annular fashion around the fuel line 8 into the interior of the catalyst tube 13. Because a high percentage of primary air is provided, the liquid fuel can be evaporated far below its boiling point. The addition of primary air can be shut off after the starting phase in the favorable case. In addition, the fine atomization of the fuel produces a large evaporative surface and the flow of the primary air produces good mass transfer figures. The energy for evaporation is provided by the heat of the preheated air plus added heat (by conduction, convection, and radiation) from the catalyst tube 13.

The mixture of combustion gas and air flows downward inside the evaporation or burner chamber 40. A cone 45 placed on the bottom of the burner chamber 40 guides the gas at the lower end of the catalyst tube 13 into the annular gap 15 between the ceramic tube, 11 and the catalyst tube 13. At this point the secondary air 46 is added, entering directly from below into the annular gas gap. The cone 45 has two primary functions. It causes the mixture of combustion gas and air to flow uniformly into the annular gap 15. Without this cone 45, areas of dead space could readily form at the bottom of the burner, at which any cracked products that might appear could collect. Another important point is that the cone 45 is heated by the radiation from the evaporation chamber 40 (the back of the catalyst chamber). In this way, portions of the fuel can be prevented from condensing out again at the bottom of the burner or when they are guided into the gas gap.

The combustion gas/air mixture with secondary air added flows upward in the annular gap 15 between the ceramic tube 11 and the catalyst tube 13. A portion of the fuel reacts with the catalytic surface. The energy thus released is distributed as follows: 1. the catalyst tube is heated or kept at the reaction temperature; 2. the reaction gas is heated; 3. heat is given-off or radiated to the interior of the catalyst tube; this heat is required to evaporate the liquid fuel mixture; the heat is transmitted by convection, conduction, and radiation; 4. heat is likewise given-off to the ceramic tube 11 from the catalyst tube through convection, conduction, and radiation; the heat is then given off further outward by conduction to the double jacket fluid chamber 4 traversed by a cooling medium 2 (water or air) in the manner of an exhaust gas heat exchanger.

The catalyst tube has a temperature of approximately 700°–900° C. Approximately 80% of the fuel is reacted in this first stage.

From the annular gap 15 in the first stage 16, the gas mixture flows upward into the expanded chamber 22 below the honeycomb 17 coated with catalyst (platinum for example). The expansion of the cross section results in a slowing of the flowrate and to additional thorough mixing ahead of the second burner stage 20. The gas then flows through the narrow channels in the catalyst honeycomb 17 where the remaining fuel is completely reacted. The good reaction yield in this second stage 20 results from the following facts: 1. The mass transfer to the catalyst is very good because of the narrow channels. 2. The low heat losses from the honeycomb and the production of heat by the reaction causes the honeycomb to reach temperatures of about 900° to 1000° C.; the reaction rate at this temperature is so high that with the relatively long residence time (low flowrate) the fuel can be reacted completely. Although only a very small amount of heat is carried away due to the poor thermal conductivity of the ceramic monolith, the primary air, whose source is located at the center of the honeycomb, can be preheated slightly. The preheating temperature of the primary air must not be too high in any case, since otherwise cracking reactions could occur when it encounters the atomized fuel.

The exhaust air from the second combustion stage is then utilized in a heat exchanger (not shown) to further heat the water or fluid 2 heated in the first combustion stage.

The entire burner is started by lighting the flame in the evaporation chamber 40. The primary air flow is so great that complete combustion is ensured. The flame heats the catalyst tube 13 from the inside by radiation, conduction, and convection. The hot offgases flow downward, are guided by the cone 45 at the bottom into the gas gap 5, and flow upward through the latter and through the honeycomb 17. The hot offgas gives up its heat, thus heating the burner with the honeycomb 17. When the burner has reached a temperature at which the catalytic reaction can proceed at a suitably high rate (approximately 600° C.), the flame is shut off. This can be done by briefly turning off the primary air and/or the fuel supply.

Any cracking products that appear and settle on the hot interior of the catalyst tube 13 can be eliminated by lighting a flame at fixed time intervals inside the catalyst tube. This flame is operated with excess air so that cracking products can be burned off the surfaces.

Figure 2:
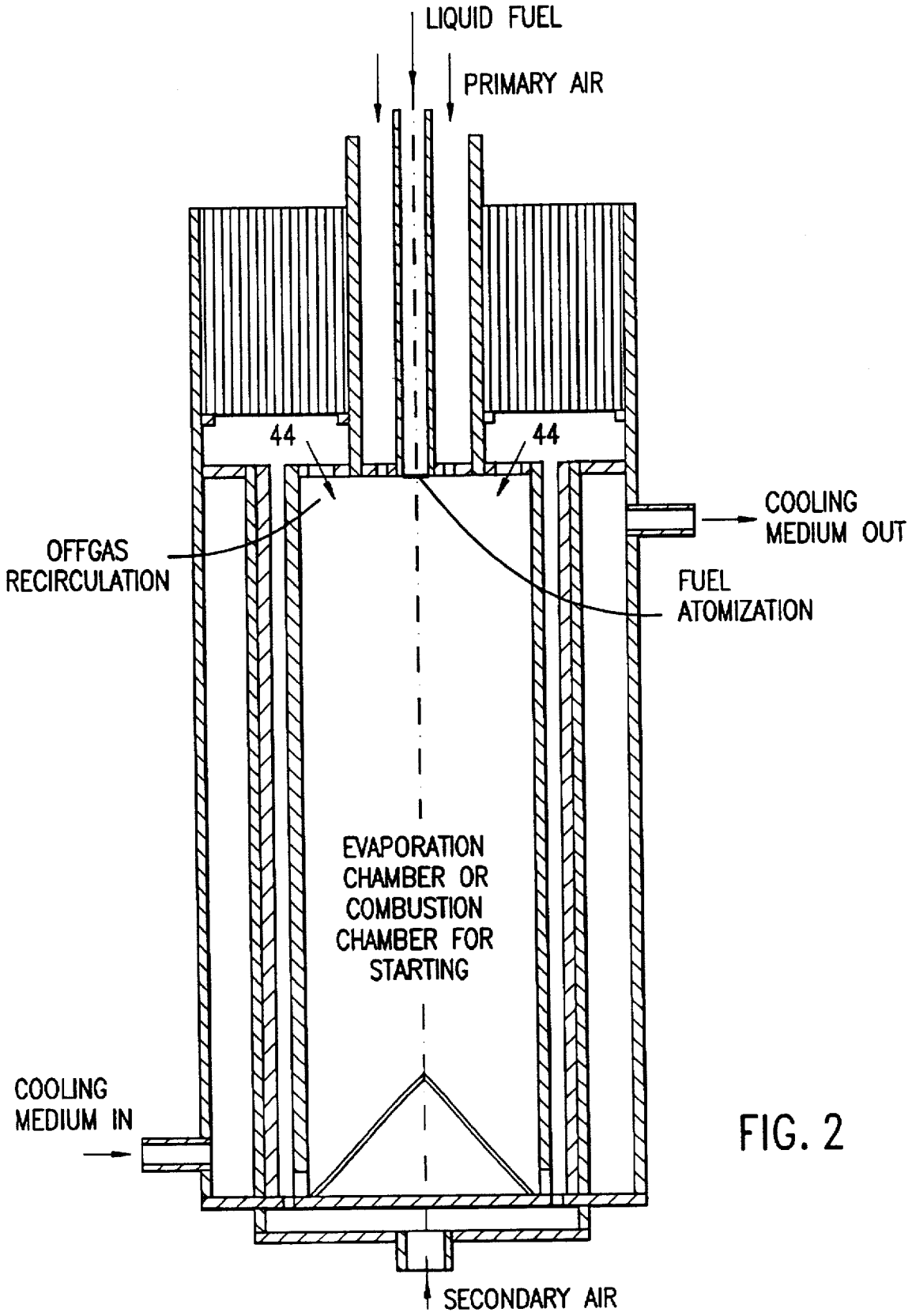
FIG. 2 is a cross-sectional representation of the catalytic burner in FIG. 1 with openings provided from the gas chamber between the first and second stages.

FIG. 2 shows the same burner once again, but in this case openings 44 have been provided from the gas chamber 21 between the first 16 and second stages 20 to the interior of the catalyst tube (evaporation chamber) 40. These openings 44, which can be designed as nozzles, cause a portion of the offgas from the first burner stage 16 to recirculate through the evaporation chamber 40. This offers the following advantages:

1. Lateral influx or intake of the offgas from the first stage ensures thorough mixing and further dilution of the fuel/air mixture inside the catalyst tube; this results in faster evaporation.

2. The hot offgas provides additional heat in the evaporation chamber that is required for evaporation.

3. The steam that is present in the recirculated offgas and comes from combustion causes portions of the fuel to be reformed into carbon monoxide or carbon dioxide and hydrogen, so that any cracking reactions that occur can be minimized.

4. With sufficient recirculation of the offgas, the primary air can be shut off.

Figure 3:
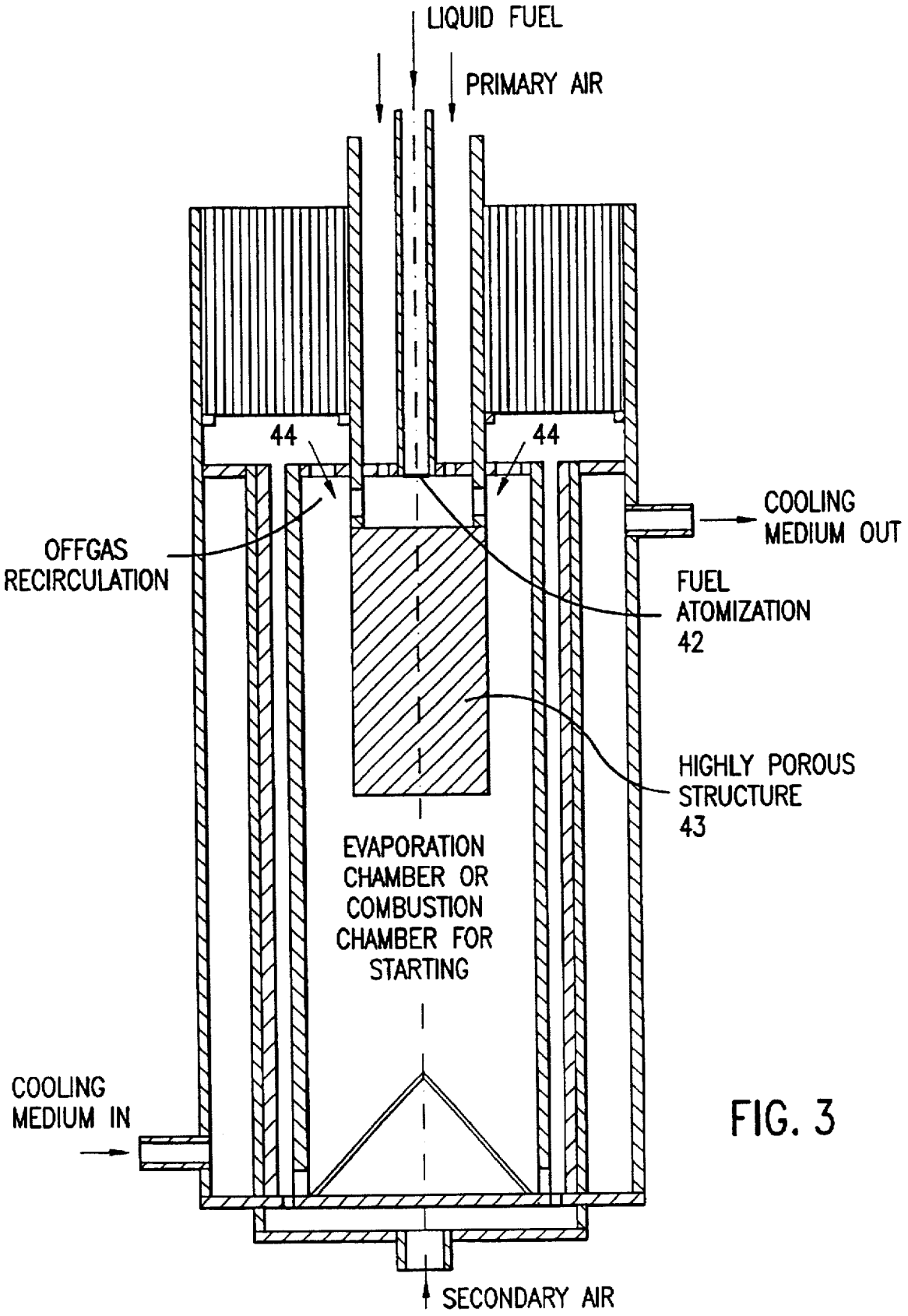
FIG. 3 is a cross-section representation of a catalytic burner in which a highly porous structure is provided inside the catalyst tube.

FIG. 3 shows a burner in which a highly porous structure 43 is provided inside the catalyst tube 13. This structure 43 causes a portion of the fuel droplets that are sprayed into it, especially the larger ones, to be deposited on the porous body and thus not come into contact with the hot wall of the catalyst tube. Because the temperatures are kept low at this point, no cracking can occur. The porous structure 43 can consist of ceramic or metal and be designed as a parallelipiped, cylinder, or tube. The structure can also be coated with catalyst in order to accelerate the evaporation reaction.

According to the invention, the first stage 16 of the two-stage catalytic burner is thermally coupled to the evaporation chamber 40. The evaporation chamber 40 simultaneously serves as the combustion chamber for preheating. The thermal coupling between the first catalyzer stage and the evaporation chamber allows a flow of heat during the starting phase from this chamber, which is then the combustion chamber, into the first catalyzer stage and, during catalytic burner operation, conversely produces a flow of heat from the first catalyzer stage to the evaporation chamber in order to produce the required evaporation enthalpy there.

The theoretical design of the burner according to the invention is not limited to the tube geometry shown but can also be transferred to rectangular channels or plate-shaped arrangements.

The hot water heater can also be used advantageously for heating warm air or another fluid to be heated.

We claim:

1. A hot water heater,comprising a first inlet for a liquid fuel;

a plurality of inlets for air;

a second inlet for a fluid to be heated;

a first combustion stage traversed by a fuel-air mixture;

a second combustion stage traversed by the fuel-air mixture;

a fluid chamber for said fluid from the second inlet;

wherein said first combustion stage comprises a combustion chamber having an outer wall and including therein an evaporation chamber, said evaporation chamber having a catalyst layer at least partially surrounding an outer surface of said evaporation chamber; and wherein said fluid chamber at least partially surrounds said outer wall of said combustion chamber such that exhaust gas from said evaporation chamber flows between said catalyst layer and said outer wall of said combustion chamber.

2. A hot water heater according to claim 1, wherein the combustion chamber of the first combustion stage is a catalytic cracking burner.

3. A hot water heater according to claim 1, wherein the evaporation chamber is designed as a combustion chamber for starting the hot water heater, said evaporation chamber having a source of primary air and an ignition device and a heated inlet for liquid fuel.

4. A hot water heater according to claim 3, wherein the ignition device includes its own source of combustion gas.

5. A hot water heater according to claim 1, wherein a fuel supply to said evaporation chamber is thermally insulated.

6. A hot water heater according to claim 1, further comprising at least one of a nozzle and porous structure for at least one of atomization and evaporation of the liquid fuel.

7. A hot water heater according to claim 6, wherein said nozzle is one of a piezocrystal, porous ceramic, and vorticization nozzle.

8. A hot water heater according to claim 1, further comprising an opening provided for offgas recirculation from an outlet of the first combustion stage to the evaporation chamber.

9. A hot water heater according to claim 1, further comprising a device provided in the combustion chamber for guiding a gas stream.

10. A hot water heater according to claim 1, wherein the combustion chamber is movable.

11. A hot water heater according to claim 10, wherein said combustion chamber is rotated.

12. A hot water heater according to claim 1, wherein the outer surface of the evaporation chamber is a cylinder, said cylinder having at least a partial catalyst layer on an outer jacket surface.

* * * * *